US011489290B2

(12) United States Patent
Markefka

(10) Patent No.: US 11,489,290 B2
(45) Date of Patent: Nov. 1, 2022

(54) DATA CONNECTOR ADAPTER FOR DATA TRANSMISSION AND MOTOR VEHICLE SOCKET WITH DATA CONNECTOR ADAPTER

(71) Applicant: Erich Jaeger GmbH + Co. KG, Friedberg (DE)

(72) Inventor: Klaus Markefka, Florstadt (DE)

(73) Assignee: ERICH JAEGER GMBH + CO. KG, Friedberg (DE)

( * ) Notice: Subject to any disclaimer, the term of this patent is extended or adjusted under 35 U.S.C. 154(b) by 0 days.

(21) Appl. No.: 17/175,719

(22) Filed: Feb. 15, 2021

(65) Prior Publication Data

US 2021/0257784 A1 Aug. 19, 2021

(30) Foreign Application Priority Data

Feb. 18, 2020 (EP) ..... 20157930

(51) Int. Cl.
*H01R 13/6474* (2011.01)
*H01B 11/00* (2006.01)
(Continued)

(52) U.S. Cl.
CPC ..... *H01R 13/6474* (2013.01); *H01B 11/002* (2013.01); *H01R 13/6581* (2013.01);
(Continued)

(58) Field of Classification Search
CPC ..... H01R 13/6474; H01R 13/6581; H01R 24/54; H01R 24/542; H01R 2201/26;
(Continued)

(56) References Cited

U.S. PATENT DOCUMENTS 3,292,117 A * 12/1966 Bryant ..... H02G 15/085 333/260
5,395,264 A * 3/1995 Keith ..... H01R 31/06 439/502

(Continued)

FOREIGN PATENT DOCUMENTS

DE 102018104253 B4 12/2019
DE 102018208532 A1 12/2019
EP 1517409 A2 3/2005

*Primary Examiner* — Abdullah A Riyami
*Assistant Examiner* — Justin M Kratt
(74) *Attorney, Agent, or Firm* — Leydig, Voit & Mayer, Ltd.

(57) ABSTRACT

A data connector adapter includes a plug body having first and second plug connection ends, an electrically conductive plug shield and a contact carrier. The first and second plug connection ends respectively have first and second plug contact connection patterns for connecting first and second data connectors. The contact carrier is arranged between the plug connection ends and carries two first contacts and two second contacts respectively forming the first and second plug contact connection patterns. One of the first contacts in each case is electrically conductively connected to one of the second contacts via a contact connection section. The first and second contacts are surrounded at least in sections respectively by electrically insulating first and second carrier bodies having first and second dielectric constants $\varepsilon_{R1}$, $\varepsilon_{R2}$. Outer circumferential surfaces of the carrier bodies bear against an inner wall surface of the plug shield at least in sections.

18 Claims, 7 Drawing Sheets

(51) Int. Cl.

| | |
|---|---|
| ***H01R 13/6581*** | (2011.01) |
| ***H01R 24/54*** | (2011.01) |
| *H01R 13/504* | (2006.01) |
| *H01R 31/06* | (2006.01) |
| *H01R 13/6477* | (2011.01) |

(52) U.S. Cl.
CPC ..... *H01R 24/54* (2013.01); *H01R 24/542* (2013.01); *H01R 13/5045* (2013.01); *H01R 13/6477* (2013.01); *H01R 31/06* (2013.01); *H01R 2201/26* (2013.01)

(58) Field of Classification Search
CPC ..... H01R 13/5045; H01R 31/06; H01R 13/6477; H01B 11/002
See application file for complete search history.

(56) References Cited

U.S. PATENT DOCUMENTS

| | | | | |
|---|---|---|---|---|
| 6,164,977 | A * | 12/2000 | Lester | H01R 24/50 439/63 |
| 2016/0079709 | A1 | 3/2016 | Su et al. | |
| 2016/0365674 | A1* | 12/2016 | Abe | H01R 13/6581 |
| 2021/0151937 | A1* | 5/2021 | Venkadari Yogendra | H01R 13/04 |

* cited by examiner

Fig. 2
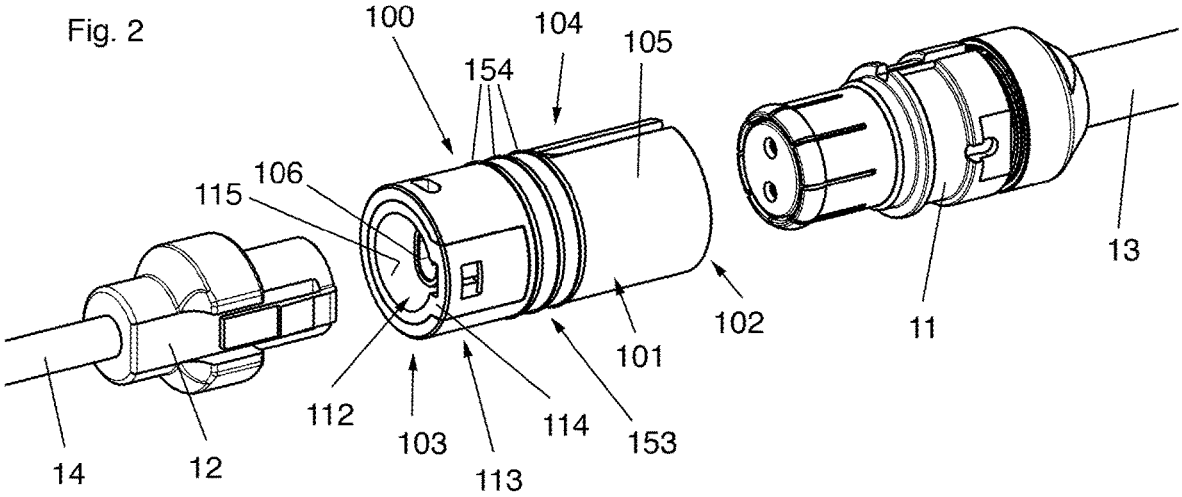
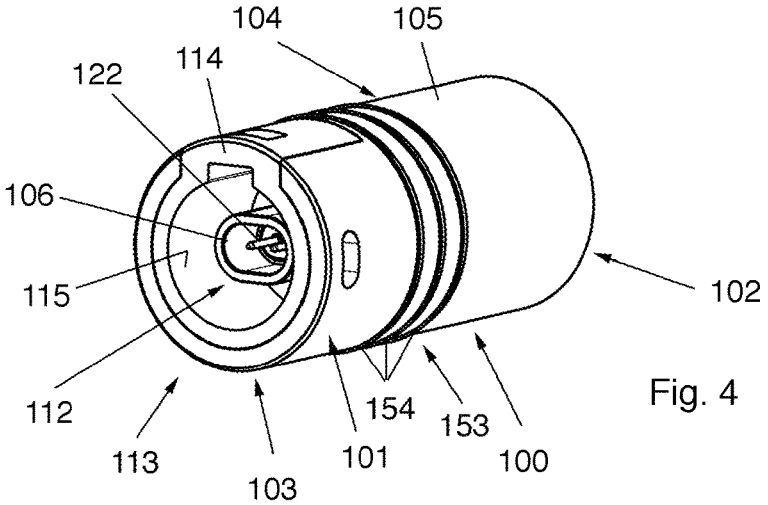
Fig. 4

Fig. 6
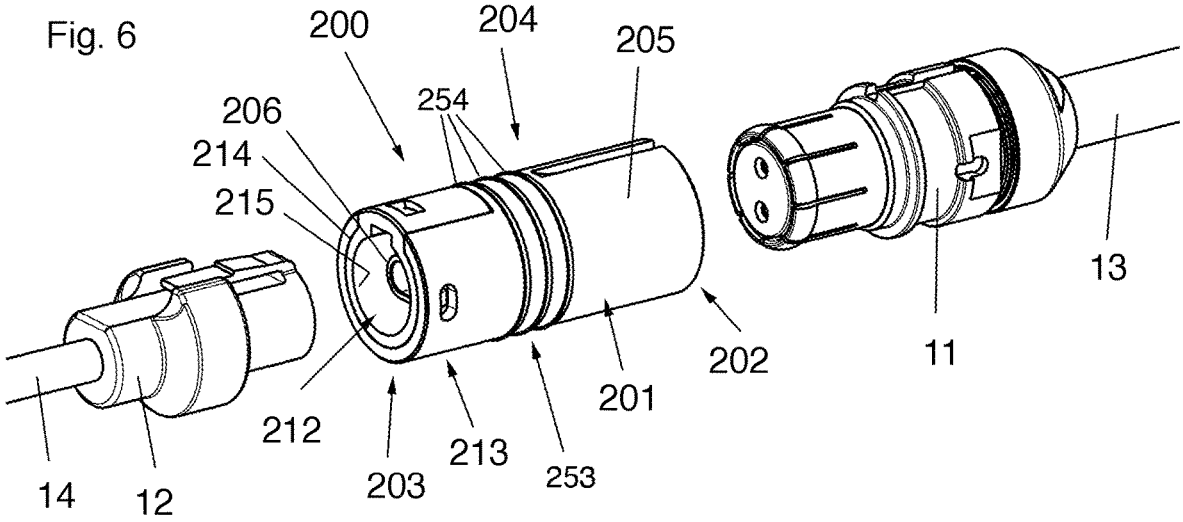
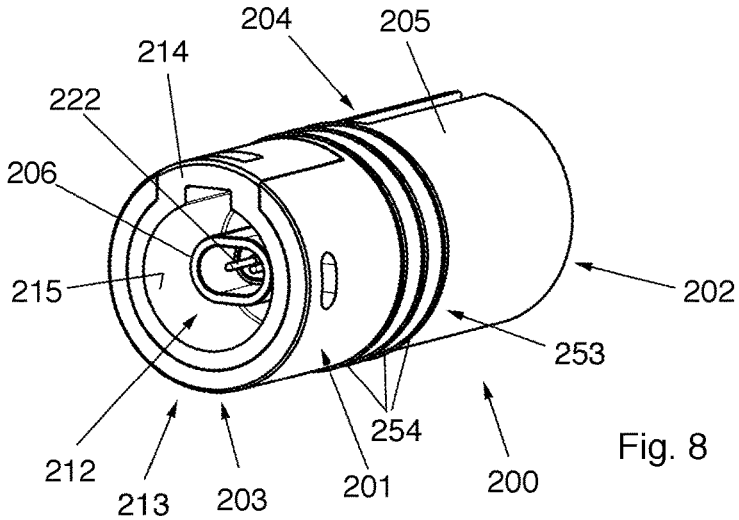
Fig. 8

DATA CONNECTOR ADAPTER FOR DATA TRANSMISSION AND MOTOR VEHICLE SOCKET WITH DATA CONNECTOR ADAPTER

CROSS-REFERENCE TO PRIOR APPLICATION

Priority is claimed to European Patent Application No. EP 20 157 930.7, filed on Feb. 18, 2020, the entire disclosure of which is hereby incorporated by reference herein.

FIELD

The invention relates to a data connector adapter for data transmission. Such a data transmission can be employed, for example, between a towing vehicle and a trailer or between a vehicle and a vehicle engine, for example an agricultural vehicle and an agricultural machine which can be attached to the agricultural vehicle. In particular, the leak-tightness necessary for such applications in the automotive field can also be achieved with the data connector adapter. The data connector adapter has a plug body having a first plug connection end, a second plug connection end, an electrically conductive plug shield surrounding in particular the first and second plug connection ends, and a contact carrier. The first plug connection end comprises a first plug contact connection pattern for connecting a first data connector, and the second plug connection end comprises a second plug contact connection pattern for connecting a second data connector.

Within the scope of the invention, the plug contact connection patterns can basically be adapted to circumstances, in particular to different data connectors with which the data connector adapter according to the invention is to be used without departing from the subject-matter of the invention. The data connectors are not part of the invention; to the extent that data connectors are described by way of example in this text, this serves only to explain other features of the invention and to illustrate them.

According to the invention, the contact carrier of the data connector adapter is arranged between the first and the second plug connection ends and carries at least two first contacts and at least two second contacts which are arranged such that the first contacts form the first plug contact connection pattern and the second contacts form the second plug contact connection pattern. In each case exactly one of the first contacts is electrically conductively connected to exactly one of the second contacts via a contact connection section. The contacts in the data connector adapter thus assume the function of conductors in data cables when the data signals are forwarded in the connector adapter. In data cables, the data is usually transmitted via conductor pairs via which signal waves are forwarded.

BACKGROUND

The line-wave resistance, which is also referred to as impedance or cable impedance, has a significant effect on the quality of the data transmission via the conductors. Geometric changes in the course of the conductors influence the conduction wave resistance. Such impedance changes can disturb the data transmission and, as interference, reduce in particular the range of data transmission and/or the maximum data rate attainable. When data cables are introduced into data connectors, and in particular in the case of data connector adapters for connecting data connectors having different plug contact connection patterns, as is the function of the data connector adapter according to embodiments of the invention, the necessary geometric changes in the course of the conductors and the dielectrics surrounding the conductors (conductor insulation, in particular of the contact carriers) cause impedance changes in the data transmission conductor. At the locations of the impedance changes, disturbances in the data transmission occur repeatedly.

High data rates such as, for example, in the range of 1 Gbit/s (gigabits per second) are to be achieved for modern applications even in the automotive sector, especially in data transmission from the motor vehicle to vehicle components arranged outside the motor vehicle, such as trailers, machines or other functions or applications that rely on data exchange with the data network of the motor vehicle. In the case of such a high-frequency data transmission, however, imperfections limit the possible data rates during data transmission, so that a data transmission with high data rates over longer transmission paths which in particular still has plug connections cannot be achieved or cannot be achieved with necessary reliability. The imperfections of a plug connector arrangement result in particular in the form of impedance changes of the cable or conductor which have an influence on the signal waves to be transmitted. From the prior art, inter alia from document DE 10 2018, 208, 532 A1, it is known that the impedance of a plug connector arrangement between plug and mating connector is to be kept constant or virtually constant along the plug-in direction in order to minimize such interference. For this purpose, the prior art proposes an impedance compensation device which has an inductance section and a capacitance section, wherein the inductance section generates a variable inductance contribution to the impedance and the capacitance section generates a variable capacitance contribution to the impedance, wherein the inductance contribution must be equal to the capacitance contribution in order to keep the impedance constant. For this purpose, an inductance section is disclosed which comprises a plurality of deflectable parts, wherein the inductance contribution can be increased and a capacitance contribution can be compensated by the deflection of the inductance section.

An alternative possibility of influencing the impedance of a plug connector arrangement is disclosed in document DE 10 2018 104 253 B4, the impedance being influenced in particular by the spacing between an outer conductor and conductors of a conductor pair or by the spacing between the conductors of the conductor pair being changed.

However, these solutions prove disadvantageous in practice in that these solutions are not reliable in a harsher environment. In this way, the conductors can move toward each other unintendedly due to outside effects, such as, for example vibrations. The impedance changes caused thereby adversely affect the data transmission. In addition, the solutions are structurally rather complex, which not only increases production costs, but also generates relative large tolerances in the cable guide, which lead to undesired impedance fluctuations.

SUMMARY

In an embodiment, the present invention provides a data connector adapter for data transmission. The data connector adapter includes a plug body having a first plug connection end, a second plug connection end, an electrically conductive plug shield and a contact carrier. The first plug connection end has a first plug contact connection pattern for connecting a first data connector and the second plug connection end has a second plug contact connection pattern for connecting a second data connector. The contact carrier is arranged between the first and the second plug connection ends and carries at least two first contacts and at least two second contacts, which are arranged such that the first contacts form the first plug contact connection pattern and the second contacts form the second plug contact connection pattern. Exactly one of the first contacts in each case is electrically conductively connected to exactly one of the second contacts via a contact connection section. The first contacts are surrounded at least in sections by an electrically insulating first carrier body having a first dielectric constant εR1. The second contacts are surrounded at least in sections by an electrically insulating second carrier body having a second dielectric constant εR2. Outer circumferential surfaces of the first and second carrier bodies bear against an inner wall surface of the plug shield at least in sections.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following:

FIG. 2 the data connector adapter according to FIG. 1 in an uncut perspective view;

FIG. 4 the data connector adapter according to FIG. 1 in a perspective view of the second connector plug connection end;

FIG. 6 the data connector adapter according to FIG. 5 in an uncut perspective view;

FIG. 8 the data connector adapter according to FIG. 5 in a perspective view of the second plug connection end.

DETAILED DESCRIPTION

Figure 1:
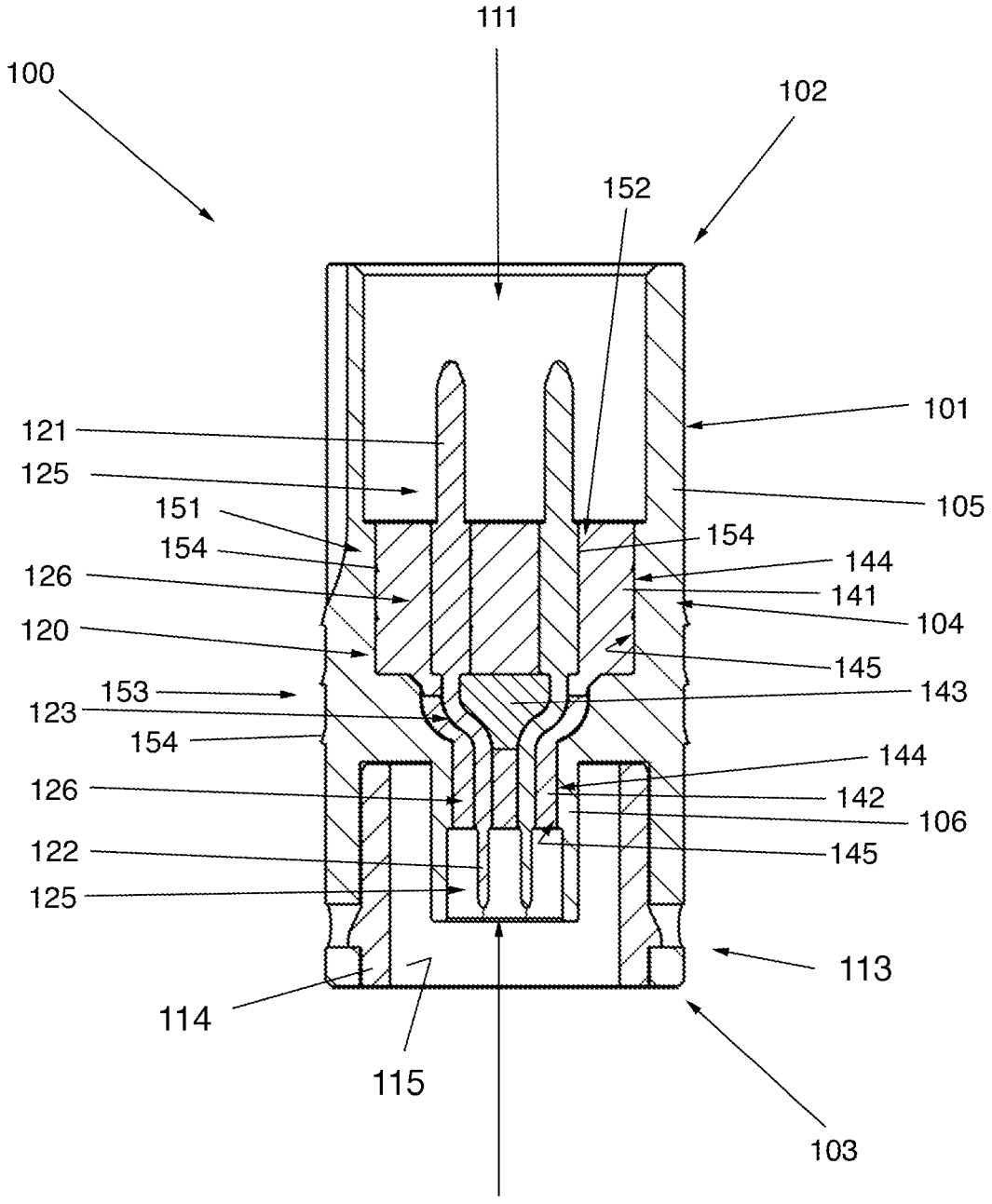
FIG. 1 a cross-sectional view of an inventive data connector adapter according to an embodiment of the invention.

In an embodiment, the present invention provides a data connector adapter for data transmission which can be produced more simply and which reliably prevents fluctuations in the impedance even in a technically harsh environment, such as plug connections in motor vehicles, and reliably enables high-frequency data transmission even in the region outside a motor vehicle.

Embodiments of the present invention provide a data connector adapter as well as a motor vehicle socket with a data connector adapter sealingly fixed in the socket. For this purpose it is provided, in particular, that the first contacts are surrounded at least in sections by an electrically insulating first carrier body having a first dielectric constant $\varepsilon_{R1}$ and the second contacts are surrounded at least in sections by an electrically insulating second carrier body having a second dielectric constant $\varepsilon_{R2}$. The different carrier bodies in the different region of the adapter (hereinafter also short for "data connector adapters") can thus influence the impedance of the adapter differently in the contact region in a simple manner. In this case, an outer circumferential surface of the first and the second carrier bodies bears against an inner wall surface of the plug shield at least in sections, but preferably completely. It has been found that the size and shape of the carrier bodies acting as dielectric is of particular importance, wherein the effect of the dielectric for the waves transported in the conductor depends in particular on when the electric fields from the dielectric are limited by the plug shield.

A complete abutment of the outer circumferential surface of the first and second carrier bodies against the plug shield means that preferably at least 80%, particularly preferably at least 90% of the outer circumferential surface bears against the inner wall surface of the plug shield. The inner wall surface of the plug shield is typically larger than the outer circumferential surface of the carrier body, so that even if the outer circumferential surface of the carrier body abuts completely, it bears against only a part of the inner wall surface of the plug shield.

Abutment means that the carrier bodies are in direct contact with the inner wall surface of the plug shield. According to an embodiment of the invention, the first dielectric constant $\varepsilon_{R1}$ and the second dielectric constant $\varepsilon_{R2}$ and the shape of the outer circumferential surface of the contact carriers as well as the shape of the corresponding inner wall surface of the plug shield against which the outer circumferential surface of the contact carriers bears can be selected such that no interference of a high-frequency data transmission with the desired data rate occurs within the data connector adapter. The dielectric constants $\varepsilon_{R1}$ and $\varepsilon_{R2}$ can be selected in particular to be different, but also identical. The person skilled in the art can determine the specific parameters for the sizes empirically by various models of the adapter and/or by theoretical calculations of the impedance of the adapter. Typically, calculation models provide a good starting point for a configuration, which can then be empirically optimized until the desired data rates can be achieved in the data transmission.

Usually, as already explained, during the transition from a first plug contact connection pattern to a second plug contact connection pattern, impedance differences occur which are caused by geometric changes of the contacts conducting the data signals (as well as of the contact connection sections between the first and the second contact), which can lead to disturbances precisely at high data rates. In the transition between the conductors of a data cable and the contacts in the plugs or plug adapters, disturbances in the data transmission can also occur, in particular because dielectric properties in the surroundings of the conductors transmitting the data signals change and thus cause impedance differences.

It has been found that the design of the adapter described according to an embodiment of the invention minimizes the impedance changes and that an optimized configuration of the dielectric constants (in particular $\varepsilon_{R1}$ and $\varepsilon_{R2}$) and the shape of the outer circumferential surfaces of the carrier bodies or of the corresponding plug shield can in particular also be produced experimentally. Data rates in the Gbit range, that is to say, for example, in the range of 1 Gbit/s (gigabits per second), can thereby be reliably realized. For wave propagation of the signal waves in the conductors, the size and shape of the dielectric surrounding the conductors is of crucial importance and determines the impedance decisively.

Geometric changes of the conductors and their relative arrangement with respect to one another and/or the dielectric around the conductor lead to location-dependent impedance changes. The shape and arrangement of the plug shield which surrounds the dielectric around the conductors also has an important influence on the impedance changes. A person skilled in the art can use the structure described according to embodiments of the invention to optimize the impedance behavior of the adapter by optimizing the dielectric constant ER as well as the shape of carrier bodies and plug shielding to such an extent that the impedance differences caused by the data connector adapter are so small that no interferences occur during data transmission at the intended data rate.

In a particularly preferred embodiment, it can be provided that a first contact spacing between the first contacts differs from the second contact spacing between the second contacts. In this case, the proposed design according to an embodiment of the invention is particularly expedient because the change in spacing between first and second contacts necessarily entails geometric changes in the design. These changes also lead to impedance changes which can be compensated by the proposed design at least to the extent that no interferences occur in data transmission at the desired data rate. The contact spacing between the first and the second contacts is to be understood such that the respective first and second contacts, between which the contact spacing is considered, are electrically conductively connected to one another by the contact connection section. The purpose of the adapter is precisely to change this contact spacing and thus to adapt it to the different plug contact connection patterns.

Additionally or alternatively, the diameter of the first and second contacts may also be different, namely a diameter of the contacting regions of the contacts and/or a diameter of the carrier regions of the contacts. Carrier regions are understood here to mean the sections of the contacts which are predominantly accommodated in the carrier body of the contact carrier or thus equivalent to being surrounded by the carrier body of the contact carrier and are not connected to the plug contacts when the plugs are being plugged in. Correspondingly, the sections of the contacts which are connected to the plug contacts when the plugs are being plugged in are understood as contacting regions. In a typical embodiment, contacting regions as contacts formed by pin contacts or male contacts project from the carrier body, while carrier regions of the contacts are accommodated in the carrier body. In particular, the first and the further contacts can have different diameters at least in their contacting region. Smaller diameters in the plug connections are usually similar to the geometric relationships in the data cable, so that impedance changes due to the changed geometry are smaller and can be compensated more easily. On the other hand, smaller diameters are geometrically more unstable and are usually designed only for a few plug-in cycles, typically once during initial installation and in some cases during possible repairs, but not in everyday use. Larger diameters lead to larger impedance fluctuations, also permit geometries which enable a high number of plug-in cycles and are thus also suitable for plug-in operations in everyday use.

In a preferred embodiment, the first and second contacts in the basic shape are cylindrical, i.e. their base surface is round. In this case, the diameter is the diameter of the round base surface. However, the invention is not limited to such an embodiment. The first and second contacts may also have a different basic geometric shape, for example a rectangular or any other basic shape. The base surface, defined as a surface perpendicular to the plug-in direction of the contacts (also referred to as the axial direction of the contacts) then has a corresponding shape. For such a case, the diameter of the contacts is defined as the largest spacing between two edge points of the base surface. In principle, the same also applies to the contact connection section between the first and second contacts.

According to an embodiment of the invention, the diameter of the first contact, second contact and contact connection section can change in accordance with an embodiment of the invention a plurality of times along the direction of the contacts accommodated in the contact carriers.

Due to the data connectors for which the data connector adapter is to be used, the first and the second contact spacings for the first and second plug contact connection pattern are frequently predetermined so that they match the provided data connectors. For adjusting the impedance such that the impedance in the data connector adapter corresponds to a predetermined impedance value, the following possibilities result in particular according to an embodiment of the invention by varying at least one, but optimally a plurality of or even all, of the following parameters:

- diameter of the first and/or second contact in the first and/or second carrier body, i.e. in the carrier region of the contacts.
- diameter of the contact connection section.
- spacing of the first contacts from the outer circumferential surface of the first carrier body.
- spacing of the second contacts from the outer circumferential surface of the second carrier body.
- spacing of the contact connection section from the outer circumferential surface of the first and/or second carrier body.
- shape of the outer circumferential surface of the first and/or the second carrier body and thus in other words the shape of the inner wall surface of the plug shield in the regions in which the outer circumferential surface of the first and/or second carrier body bears against the inner wall surface.
- dielectric constant $\varepsilon_{R1}$ of the first carrier body
- dielectric constant $\varepsilon_{R2}$ of the second carrier body.

It has been found that these parameters substantially influence the impedance behavior of the adapter, and thus a variation of these parameters in coordination with one another leads to the impedance in the data connector adapter corresponding to a predetermined impedance value, which corresponds in particular to the impedance of the data cables used for the data transmission.

A particularly preferred embodiment of the invention provides that at least a third carrier body having a third dielectric constant $\varepsilon_{R3}$ is provided in the region of the contact connection section, wherein the dielectric constant $\varepsilon_{R3}$ with the first dielectric constant $\varepsilon_{R1}$ and/or the second dielectric constant $\varepsilon_{R2}$ can be selected to be the same or different. The number of different carrier bodies, which in particular directly surround the first contacts, the second contacts and/or the contact connection sections (or else in some cases surround them only indirectly, that is for example, enclose contacts and a contact carrier directly surrounding these contacts) increases the possibilities for influencing the impedance in the data connector adapter, so that ultimately even small local imperfections can be addressed and the impedance changes can be kept small enough for reliable data transmission at the desired data rate to be possible. It has been found that adapters having at least three carrier bodies show very good results in practice. Similarly to the first and second carrier bodies, the third carrier body can surround sections of the contacts over a wide area or, for example, also take the form of a circuit board in which the first and second contacts are held and contacted. Preferred variants of the third carrier body will be described in more detail later.

By providing the third carrier body according to an embodiment of the invention, the impedance in the data connector adapter can additionally or alternatively also be adjusted by varying at least one of the further parameters:

dielectric constant $\varepsilon_{R3}$ of the third carrier body.

shape of the outer surface of the third carrier body.

in such a way that the impedance in the data connector adapter corresponds to a predetermined impedance value. This enables an even greater flexibility in the adjustment of the impedance, in particular locally in the region of the contact connection section in which the conductors transporting the data signal (contacts and contract connection section) have geometric changes. At these points, a local option for influencing the impedance in the data connector adapter may be particularly helpful.

An expedient development of the third carrier body according to the invention may provide, according to one possible embodiment, that the third carrier body is provided in particular also in a region between different contact connection sections, wherein each of the contact connection sections connects one of the first contacts and one of the second contacts. In particular, the third carrier body can be arranged in a region in which the spacing between the first contacts and between the second contacts changes. This results in the possibility of a very local influence on the impedance.

According to further developments of a third (or further) carrier body which are additionally or alternatively proposed according to an embodiment of the invention, this third or further carrier body can have an electrically conductive contact shield which is electrically conductively connected to the plug shield. Such a contact shield can be arranged in particular between the contact connection sections and/or around the contact connection sections. The shape of the contact shield and its spacing from the contact connection sections, the first contacts and/or the second contacts may also be used according to an embodiment of the invention as one (i.e., another) of the parameters through whose variation the impedance in the data connector adapter is or will be set such that the impedance in the data connector adapter corresponds to a predetermined impedance value.

One embodiment of the invention provides that one or each first contact, one or each second contact and the contact connection section connecting them in each case takes the form of a one-piece overall contact. The overall contact thus defined is thus monolithically constructed from conductive material and comprises as contact parts the first and second contacts as well as the contact connection section according to the definition of this invention. As a result, any contacting between the various contact parts that interfere under certain circumstances with data transmission is prevented. In particular, such overall contacts can easily be produced from an electrically conductive material, for example a low-alloy copper or brass, for example as male contacts. These overall contacts, but also each of the contact parts (first contact, second contact, contact connection section) can preferably have different diameters in sections along their axial direction. For example, a contact region of the first contact may have a diameter of about 1.3 mm (or between 1.0 and 1.5 mm), and the carrier region of the first contact may have a diameter of about 2.0 mm (or between 1.5 and 2.5 mm). Such diameters are suitable, for example, for connection to data connectors of data cables which have conductors with cross-sections between 0.35 and 0.75 $mm^2$ and allow Gbit data transmissions up to 40 meters. For example, a contact region of the second contact may correspondingly have a diameter of about 0.5 mm (or between 0.3 and 0.75 mm), and the carrier region of the second contact may have a diameter of about 0.8 mm (or between 0.5 and 1.0 mm). Such diameters are suitable, for example, for connection to data connectors of data cables which have conductors with cross-sections between 0.12 and 0.15 $mm^2$ and allow Gbit data transmissions of up to about 8 to 10 meters. The diameter of the overall contacts in the region of the contact connection section preferably corresponds exactly or approximately to the diameter of the first or second contact in its carrier region. Preferably, the smaller of these diameters will be or can be selected.

Such a configuration makes it possible for the overall contact in the contact connection section to be intentionally bent or curved in order to achieve a different spacing between the first and the second contacts in the plug pattern (short for plug contact connection pattern). The bending or curving of the contacts can be effected within a suitable form (in the sense of a tool), which brings the originally axially rectilinear contacts into the desired shape in a defined manner (reproducibly) during assembly. Suitable dies can be provided as separate assembly aids or, for example, be integrated into the carrier body of the contact carrier as guides for the contacts, so that the bending takes place automatically when the contacts are being inserted into the carrier bodies. Insertion of pre-bent contacts is also possible.

In such an embodiment, the first carrier body preferably has through-openings for the first contacts and the second carrier body preferably has through-openings for the second contacts. Furthermore, a third carrier body may be accommodated in the intermediate space between the contact connection sections. Preferably, the third carrier body has groove-like recesses (as guides) corresponding to the bend of the contact connection sections into which the bent contact connection sections are accommodatably received (in an assembled data connector adapter). Furthermore, the first carrier body and/or the second carrier body may have projecting collars in the direction of the contact connection section along their respective outer circumferential surfaces, which bear against the inner wall surface of the plug shield and enclose the contact connection sections with the third carrier body that is accommodated between them. In other words, this leads to the collar of the first and/or second carrier body being arranged between the contact connection sections and the plug shield. The thickness of the collar of the first and/or second carrier body can preferably correspond approximately to the spacing between the contact accommodated in the carrier body and the plug shield, so that the thickness of the dielectric having the corresponding dielectric constant $\varepsilon_{R1}$, $\varepsilon_{R2}$ between the contact transmitting the data signal and the plug shield remains approximately the same, even in the region of the contact connection section. This has proven to be a preferred configuration in many cases.

In such a development, in which all or parts of the features described in the previous paragraph are implemented, it has proven to be particularly advantageous if the outer circumferential surface of the third carrier body bears against boundary wall surfaces of the first and second carrier bodies.

If a contact shield is accommodated in the third carrier body, the plug shield can be contacted by conductors in the first and/or second carrier body, i.e. conductors which are guided through and/or around these carrier bodies.

According to a further embodiment of the invention, the plug shield can be constructed in multiple parts, wherein the plurality of parts of the plug shield are electrically conductively connected. For example, the plurality of parts of the plug shield can be secured to one another in an electrically conductive manner by being plugged into each other, by compression or by snapping on or even be joined to one another monolithically. In particular, the plug shield can have a socket which forms the base body of the plug body in which or on which the further components of the data connector adapter are fixed. Conceivable preferred embodiments for such a multi-part plug shield are described below.

In a further embodiment, in particular an alternative embodiment to the embodiment with a one-piece overall contact, the contact connection section as third or further carrier body can have a circuit board on which the first contacts and the second contacts are contacted and fixed on different sides of the circuit board by means of their circuit board connection sections, wherein conductor tracks for connecting in each case one of the first contacts to one of the second contacts (i.e., for the contact connection or in the function of the contact connection section) are provided on the circuit board and wherein a contact shield connected electrically conductively to the plug shield is provided on the circuit board around the conductor tracks that connect the contacts.

The circuit board as a third or further carrier body, on which the first and second contacts are fixed and by which the conductor tracks mounted on the circuit board are connected to one another as a component of the contact connection section, enables many different first and second plug contact connection patterns to be connected to each other easily, because the arrangement of the contacts on the circuit board can be freely set, and the electrical connection can be easily implemented by conductor tracks on the upper and/or lower side of the circuit board when there is a multi-layered design, where applicable also on intermediate layers of the circuit board. As third/further carrier body, the circuit board also has a third/further dielectric constant $\varepsilon_{R3}/\varepsilon_{Ri}$, which—at least within limits—can be influenced by the selection of the material for the circuit board carrier body. The contact shield, which can be freely inserted into circuit boards, also makes it possible to influence the impedance behavior of the data connector adapter locally and very flexibly.

Accordingly, in a preferred embodiment of the invention, the dielectric constant $\varepsilon_{R3}/\varepsilon_{Ri}$ of the third (and any further) carrier body and/or the arrangement and type of contact shielding in the third (and any further) carrier body can also be a parameter with which the impedance in the data connector adapter has been or is set by varying this parameter such that the impedance in the data connector adapter corresponds to a predetermined impedance value.

A contact shield in the third carrier body designed as a circuit board can be formed, for example, by a plurality of via points which are connected to one another by conductor tracks on one or both circuit board sides, in the case of a multilayered circuit board, possibly also in intermediate layers of the circuit board. The conductor tracks of the contact shield preferably form a closed region around the first and second contacts and the conductor tracks connecting them. The arrangement and shape of the conductor tracks of the contact shield and/or of the vias connected to these conductor tracks can be used as the parameters described above. It has been found that an expedient configuration can provide that the shape of the conductor tracks be chosen such that the spacing from the first and second contacts is as constant as possible, i.e. follows a shape in which variations in the spacing are minimized. A further, supplementary or alternative aspect in the design of the shape of the contact shield can be that the spacing of the first and second contacts from the contact shield corresponds approximately to the spacing of the conductor tracks connecting the contacts. These can preferably be arranged parallel to one another. Such an arrangement can be achieved particularly easily if the first contacts of the first contact connection pattern and the second contacts of the second contact connection pattern are rotated relative to one another, for example by a rotation about a center point or center of gravity of the connection patterns relative to the position of the contacts. A preferred configuration that allows for a large spacing between the parallel conductor tracks, or in typical arrangements the maximum spacing, results in the case of a rotation of approximately 90° (including exactly 90°).

The provision of conductor tracks also in intermediate layers of the circuit board (in particular for the conductor tracks which connect the first and second contacts as part of the contact connection section) simulates the design of a conventional conductor in a data cable and can help as a further parameter in minimizing the impedance changes in the region of the contact connection sections. The same applies if conductor tracks of the connection sections are provided on both sides of the circuit board (even without the provision of intermediate layers).

In principle, it is also conceivable to insert monolithically formed and correspondingly curved overall contacts into passages of a circuit board and fix them there. In such a configuration, the above-described embodiments could also be expediently combined with one another, wherein the circuit board can in particular take the form of a further (for example fourth) carrier body. At least for continuous overall contacts, no conductor tracks on the circuit board would be necessary as contact connection sections. According to the invention, embodiments are also conceivable in which a portion of the contacts is designed as one-piece overall contacts (in the above-defined sense) and another portion of the contacts as separate first and second contacts which are connected to one another via a contact connection section provided as a conductor track on the circuit board.

The design of an embodiment of the invention may further provide for the plug shield to have a multi-part structure, wherein a first part of the plug bodies is a socket in which the first and second contacts together with the contact connection sections and the carrier bodies, i.e. the first, second and in some cases third and further carrier bodies, are accommodated and which preferably also forms insertion openings for the data connectors that can be plugged into the data connector adapters. In this embodiment, at least one second part is provided which is arranged in the first part and one of the first or second plug contacts surrounds connection patterns, i.e. is arranged at a smaller spacing from the first or second contacts than the first part of the plug shield. According to an embodiment of the invention, the first part of the plug shield and the second or any further part of the plug shield can be monolithically formed from one piece of material. However, it is also possible to form the first part of the plug shield and the second or any further part of the plug shield in each case as a part made of electrically conductive material and to arrange it in an electrically conductive connection in the data connector adapter. For example, the first part of the plug shield can be inserted and/or pressed into the second part of the plug shield. Any other type of fixing of the first and second parts is also covered according to embodiments of the invention.

An optimum of the parameters used for optimizing impedance, which have already been described in detail, can be determined according to one possible embodiment by calculating the impedance in a physical model of the data connector adapter. Since the parameters partially influence one another, a plurality of optimal parameter values may exist, wherein the impedance in the data connector adapter preferably corresponds or is supposed to correspond to a predetermined impedance value of the data cable. However, determination of the parameters in a physical model is relatively complex, because the theoretical calculation of the impedance necessitates a precise consideration of the materials used and of geometric relationships.

An alternative possibility for optimizing the parameters is therefore to carry out a measurement of the impedance in the data connector adapter, in particular by means of time-domain reflectometry measuring devices. In time-domain reflectometry (TDR), run lengths and reflection characteristics of electromagnetic waves and signals in cables or signal conductors are determined. Such a method or similar methods are known to a person skilled in the art. They are based on a pulse generator generating a sequence of very short signals which are fed into the cable or the adapter. In a measuring device, the signal amplitudes and the propagation time of the signals are compared to the signal that is fed in. Interference sources can be located by the comparison. Consequently, the interference sources are detected in particular by the impedance deviating, in particular deflecting, at the interference source.

Accordingly, in order to adapt the impedance of the data connector adapter to the desired impedance value, for example the impedance value of the data cable and/or the data connector connected thereto, data connectors with data cables can be connected to one or both ends of the data connector adapter, and interference sources can be determined in a spatially resolved manner by the described measurement. By varying the parameters, the interference sources can then be eliminated or at least reduced to such an extent that the interferences do not stand in the way of reliable data transmission at the desired data rate.

It has been found that the proposed data connector adapter in the above-described basic configuration frequently has an impedance of about 100 ohms, which conventional data cables also have. A similar impedance value here means that the impedance deviates by no more than 5% from an average impedance over the length of the data connector adapter, and the impedance over the length of the data connector adapter thus lies preferably in the range of 100±5Ω.

Accordingly, it has proven to be a preferred embodiment to use empirically determined parameters in which, in measurements by means of time-domain reflectometry, measuring devices in a data connector adapter connected with data connectors do not indicate any impedance changes or interferences which interfere with a data transmission at the desired data rate. For the measurements, the data connector adapter (preferably on both sides) can be connected to a data connector with data cables. Interferences are understood in particular to mean impedance changes of a magnitude which interfere with a data transmission at the desired data rate.

The particular order of magnitude can in some cases be determined empirically by a person skilled in the art. Optimization can therefore be effected in particular by the measured impedance over the length of the data connector adapter being virtually identical to the impedance of the cable outside the adapter, or in other words no imperfections are detected within the data connector adapter that adversely affect data transmission.

Especially for the preferred use of the data connector adapter proposed according to an embodiment of the invention in the outer region of motor vehicles, i.e. in motor vehicle data connector adapters as a particularly preferred embodiment of the invention, it corresponds to a particularly preferred embodiment if the data connector adapter is protected against moisture penetration by at least one seal. Preferably, at least two seals are provided, wherein one seal seals the contact surface of the plug shield and contact carrier, in particular the first and/or second carrier body, and a further seal seals the contact surface of contact and contact carrier, in particular the first and/or second carrier body. This reliably prevents the penetration of moisture into the data wiring in the region of the data connector adapter according to an embodiment of the invention. This is very important, especially in the field of high-frequency data transmission (i.e. particularly at transmission rates of up to 1 Gbit/s), because penetrating moisture can lead not only to short circuits should it come into contact with the conductors themselves but can also change the impedance of the conductor dielectric system and thus lead to interference in data transmission.

In the usual way, sealing can be achieved by suitable, for example elastomeric seals (such as flat or annular seals, O-ring seals or the like), which bear under pressure between the contact surfaces to be sealed and thus produce their sealing effect. In this case, special cleanliness must be ensured during assembly, because any foreign bodies between the contact surfaces and the seal will cause leaks. Moreover, separate components are possible as seals.

A particularly preferred possibility for sealing the data connector adapter therefore provides for the seals to be formed as mandrel profiles (for example in the sense of triangular projections) on the more fixed components, i.e. the inner wall surfaces of the plug shield (or the plug body) made of a metallic material and the outer circumference of the contacts made of metallic material, each of which presses into the contact surfaces of the abutting material, i.e. the first and/or second carrier body of the contact carrier (and/or other parts of the contact carrier), under contact pressure and thus achieves sealing. With this type of sealing, the given standards for the outer region of motor vehicles, such as ISO 4091, LV 214, USCAR 2, SAE, etc., are satisfied. Furthermore, the components are secured to one another more displacement-resistantly, in particular if—as in the preferred embodiments of the invention—they are connected to one another by being plugged together.

In this connection, it is particularly preferred according to an embodiment of the invention if the mandrel profiles do not project symmetrically from the contact surface, but instead form a run-up slope on one side (in particular in the joining direction) and on the other side form an abrupt shoulder (in particular counter to the joining direction). This facilitates the joining of the components and makes a release of the components counter to the sliding direction more difficult. In a particularly preferred embodiment, the two mandrel profiles of the two seals, i.e. the mandrel profile against the inner wall surface of the plug shield and the mandrel profile against the contacts, are directed against the run-up slope. A high strength of the joined components is thereby achieved.

A further preferred embodiment of the invention can provide that a proprietary connection region be formed at at least one of the first and second connection ends and have a plug adapter sleeve which can be plugged into the plug body and respectively surrounds the first or second plug contact connection pattern, wherein the inner wall of the plug adapter sleeve is designed to receive the respective first or second data connector. The plug adapter sleeve can be made of plastic, for example, and can be snapped onto the plug body. This achieves a modular design of this plug connection end, which can be adapted to a plurality of different data connectors by exchanging the plug adapter sleeve. This is particularly effective, in particular, because the plug contact connection pattern with the arrangement of the contacts and the plug shield surrounding the contacts corresponds to a fixed structure (for example due to standardizations or agreements regarding the interoperability of data plug connections), but the outer region of the plugs is available for proprietary purposes. With the proposed data connector adapter provided on at least one of the plug connection ends with modular plug adapter sleeves, this adapter can be used universally for a plurality of data connectors.

A particularly preferred use of the data connector adapter according to the invention is in data transmission between motor vehicles and motor vehicle components, such as trailers, machines or other applications for motor vehicles or the components thereof, at desired data rates above 100 bits/s, in particular high data rates in the Gbit/s range. Data transmission in motor vehicles and from motor vehicles to trailers, machines or other motor vehicle components to be connected to the data network of the motor vehicle, in particular in the outer region of the motor vehicle, is becoming increasingly important for different applications. For this purpose, it is necessary to provide correspondingly robust data connector adapters, which on the one hand can be adapted to a wide variety of data wirings in motor vehicles with proprietary data connectors and, on the other hand, offer the possibility of inserting data connectors of components to be connected to the motor vehicles into the adapters in a plurality of plug-in cycles. Moreover, the adapter must also be suitable for accommodating data cables having larger cross-sections with their correspondingly larger data connectors. The cable cross-sections and data connectors used in motor vehicles allow only a limited range of data transmission at the aforementioned high data rates. As a rule, larger ranges in wired high-frequency data transmission can be achieved by means of larger cable cross-sections. In addition to passenger cars, the data connector adapter proposed according to embodiments of the invention is also particularly suitable for trucks, agricultural vehicles or construction vehicles, in particular with machines or functions to be connected to data communication technology. In particular, embodiments of the invention therefore relate to a vehicle data connector adapter which is specially adapted for use in the motor vehicle sector and has, in particular, the leak-tightness needed for applications in the outer region of motor vehicles.

In this context, embodiments of the invention also relate to a motor vehicle socket for the data transmission from a motor vehicle to a motor vehicle component having a socket housing which has an insertion opening for connecting a plug of the vehicle component and a connection opening for connecting the socket to a motor vehicle data network or vehicle electrical system, wherein the insertion opening can be sealingly closed off by a hinged cover on the socket housing. The above-described data connector adapter is sealingly fixed in the socket housing, wherein one of the two plug connection ends of the data connector adapter is accessible in the insertion opening and the other of the two plug connection ends of the data connector adapter is accessible in the connection opening.

The sealing fixation of the data connector adapter in the motor vehicle socket can be effected by a suitable (single- or multi-part) seal between the outer circumference of the data connector adapter and a through-opening of the socket housing into which the data connector adapter can be accommodated and in which the data connector adapter is fixed. In a particularly preferred embodiment, the data connector adapter can have on one perimeter a mandrel profile (corresponding to the type already described) which, when the data connector adapter is fixed in the through-opening of the socket housing, compresses under contact pressure into the socket housing, which is in particular made of plastic. A sealing connection can also be produced, for example, by injection molding or encapsulation.

In order to also enable a power supply in addition to data transmission or to achieve individual electrical switching processes directly by switching on and off the operating power, at least one further electrical contact, but preferably a plurality of further electrical contacts, can be sealingly integrated into the socket housing of the motor vehicle socket in a manner known per se. The further electrical contacts can preferably also be contacted in the insertion opening and connection opening of the motor vehicle socket.

Further features, advantages and application possibilities of the present invention are revealed by the following description of exemplary embodiments and the drawings. All of the features described and/or illustrated by themselves or in any combination here form the subject-matter of the present invention, regardless of how they are summarized in described or illustrated exemplary embodiments.

A first embodiment of a data connector adapter 100 according to the invention is described below in reference to FIGS. 1 to 4, and a second embodiment of a data connector adapter 200 according to the invention is described below in reference to FIGS. 5 to 8, wherein reference numerals are used for comparable parts that in each case differ by the amount 100. A plurality of the functions and advantages of the various components of the data connector adapters 100, 200 according to the invention have already been described and may also be gathered from the drawings with the corresponding understanding of a person skilled in the art. These are no longer repeated in the description of the figures below, but are correspondingly valid for all specific exemplary embodiments.

Figure 9:
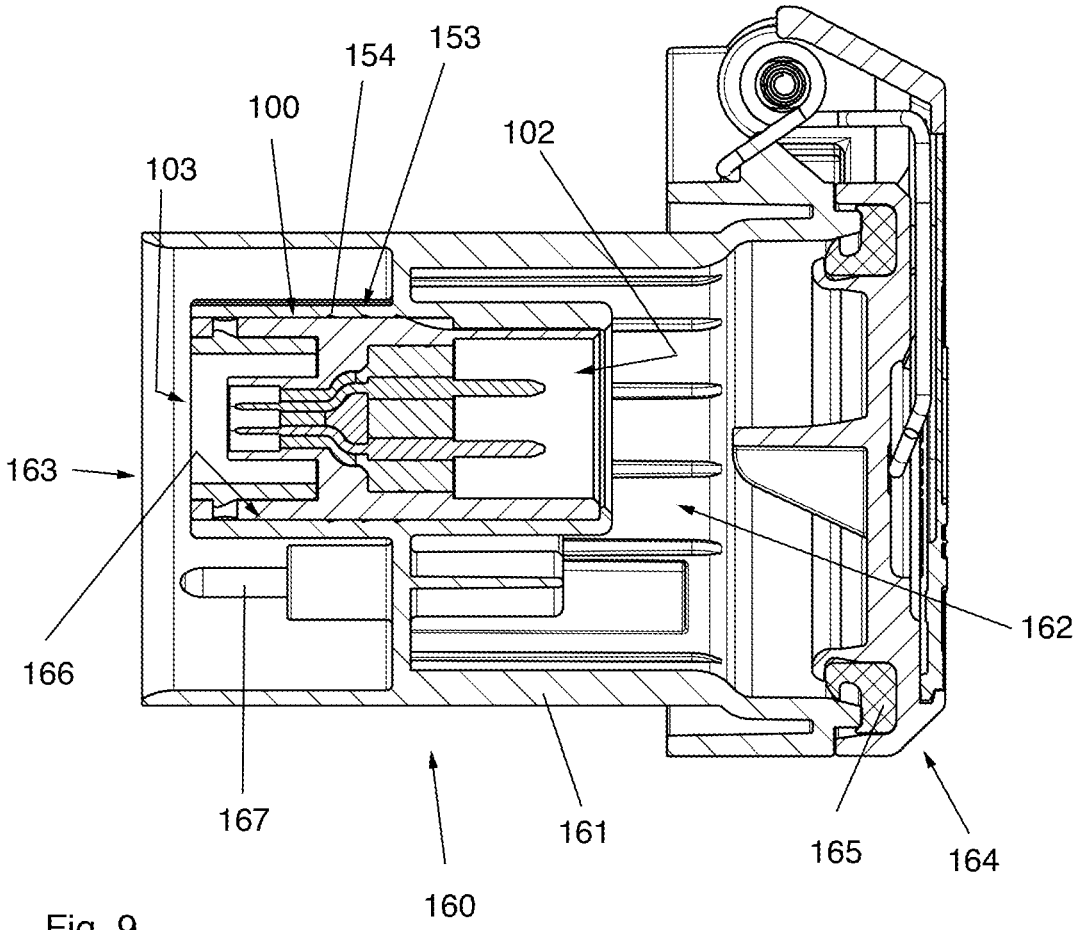
FIG. 9 a cross-sectional view of a motor vehicle socket according to an embodiment of the invention with a data connector adapter according to an embodiment of the invention and accommodated in the socket housing.

A motor vehicle socket 160 according to the invention is illustrated and described in FIG. 9 with an accommodated data connector adapter 100 according to the first embodiment. It goes without saying that this is only an example and all shown and all described components of the motor vehicle socket can be realized in the same way with an accommodated data connector adapter 200 according to the second embodiment.

The data connector adapter 100 shown in FIG. 1 has a plug body 101 with a plug connection end 102 and a second plug connection end 103. The first and plug connection ends 102, 103 are surrounded by an electrically conductive plug shield 104 comprising a socket-type first section of the plug shield 105 and a second part of the plug shield 106.

The first part of the plug shield 105 forms an insertion opening for a data connector at both the first and second plug connection ends 102, 103. The first plug connection end 102 shows a first plug contact connection pattern 111 for the connection of a first data connector 11 and the second plug connection end 103 a second plug contact connection pattern 112 for the connection of a second data connector 12.

A contact carrier 120 is accommodated in the plug body 101, wherein the contact carrier 120 is arranged between the first and second plug connection ends 102, 103 and carries at least two first contacts 121 and at least two second contacts 122, which are arranged such that the first contacts 121 form the first plug contact connection pattern 111 and the second contacts 122 form the second plug contact connection pattern 112. Exactly one of the first contacts 121 is electrically conductively connected to exactly one of the second contacts 122 via a contact connection section 123.

The first part of the plug shield 105 also surrounds the first contacts 121 at the first plug connection end 102. In contrast, the second contacts 122 are surrounded by the second part of the plug shield 106, which is arranged within the first part of the plug shield 105. In this first exemplary embodiment, the first part of the plug shield 105 and the second part of the plug shield 106 are monolithically designed as a common plug shield 104 which simultaneously also forms the plug body 101.

In this exemplary embodiment, the contacts are provided as a one-piece overall contact 124, i.e., the first contact 121, the second contact 122 and the contact connection section 123 between these contacts 121, 122 are monolithically made of a conductive material.

The first contacts 121 are surrounded at least in sections (with their carrier region 126) by an electrically insulating first carrier body 141 having a first dielectric constant $\varepsilon_{R1}$, and the second contacts 122 are surrounded at least in sections (with their carrier region 126) by an electrically insulating second carrier body 142 having a second dielectric constant $\varepsilon_{R2}$, wherein the outer circumferential surfaces 144 of the first and second carrier bodies 141, 142 each bear against an inner wall surface 145 of the plug shield 104, specifically against an inner wall surface 145 of the first part of the plug shield 105 and of the second part of the plug shield 106, respectively.

The contacting regions 125 of the first and second contacts 121, 122 project from their respective carrier bodies 141, 142.

In this embodiment, a third carrier body 143 having a third dielectric constant $\varepsilon_{R3}$ is provided in the region of the contact connection section 123 and is positioned between the contact connection sections 123 of the first and second contacts 121, 122.

According to an embodiment of the invention, the diameters of the first and/or second contact 121, 122 in the first and/or second carrier body 141, 142, the diameters of the contact connection section 123, the spacing of the first contacts 121 from the outer circumferential surface 144 of the first carrier body 141, the spacing of the second contacts 122 from the outer circumferential surface 144 of the second carrier body 142, the spacing of the contact connection section 123 from the outer circumferential surface 144 of the first and/or second carrier body 141, 142, the shape of the outer circumferential surface 144 of the first and/or the second carrier body 141, 142 (and thus in other words the shape of the inner wall surface 145 of the plug shield 104 in the regions in which the outer circumferential surface 144 of the first and/or second carrier body 141, 142 bears against the inner wall surface), the dielectric constant $\varepsilon_{R1}$ of the first carrier body 141, the dielectric constant $\varepsilon_{R2}$ of the second carrier body 142, the dielectric constant $\varepsilon_{R3}$ of the third carrier body 143 and/or the shape of its outer surface are set in such a way that the impedance in the data connector adapter 100 corresponds to a predetermined impedance value and a data transmission through the data connector adapter 100 at the desired data rate is not disturbed. This has already been described in detail.

FIG. 2 shows a three-dimensional general view of the data connector adapter 100 with the plug body 101, the first plug connection end 102 for connection to a first data connector 11 and the second plug connection end 103 for connection to a second data connector 12. The first data connector 11 is connected to a first data cable 13 of larger cross-section and the second data connector 12 is connected to a second data cable 14 of smaller cross-section. The plug shield 104 has the first part of the plug shield 105, which surrounds the first plug contact connection pattern 111, and the second part of the plug shield 106, which surrounds the second plug contact connection pattern 112.

A proprietary connection region 113 is formed at the second connection end 103 around the second plug contact connection pattern 112 and has a plug adapter sleeve 114 which can be plugged into the plug body 101 and surrounds the second plug contact connection pattern 112, wherein the inner wall 115 of the plug adapter sleeve 114 is designed to receive the second connector 12.

Figure 3:
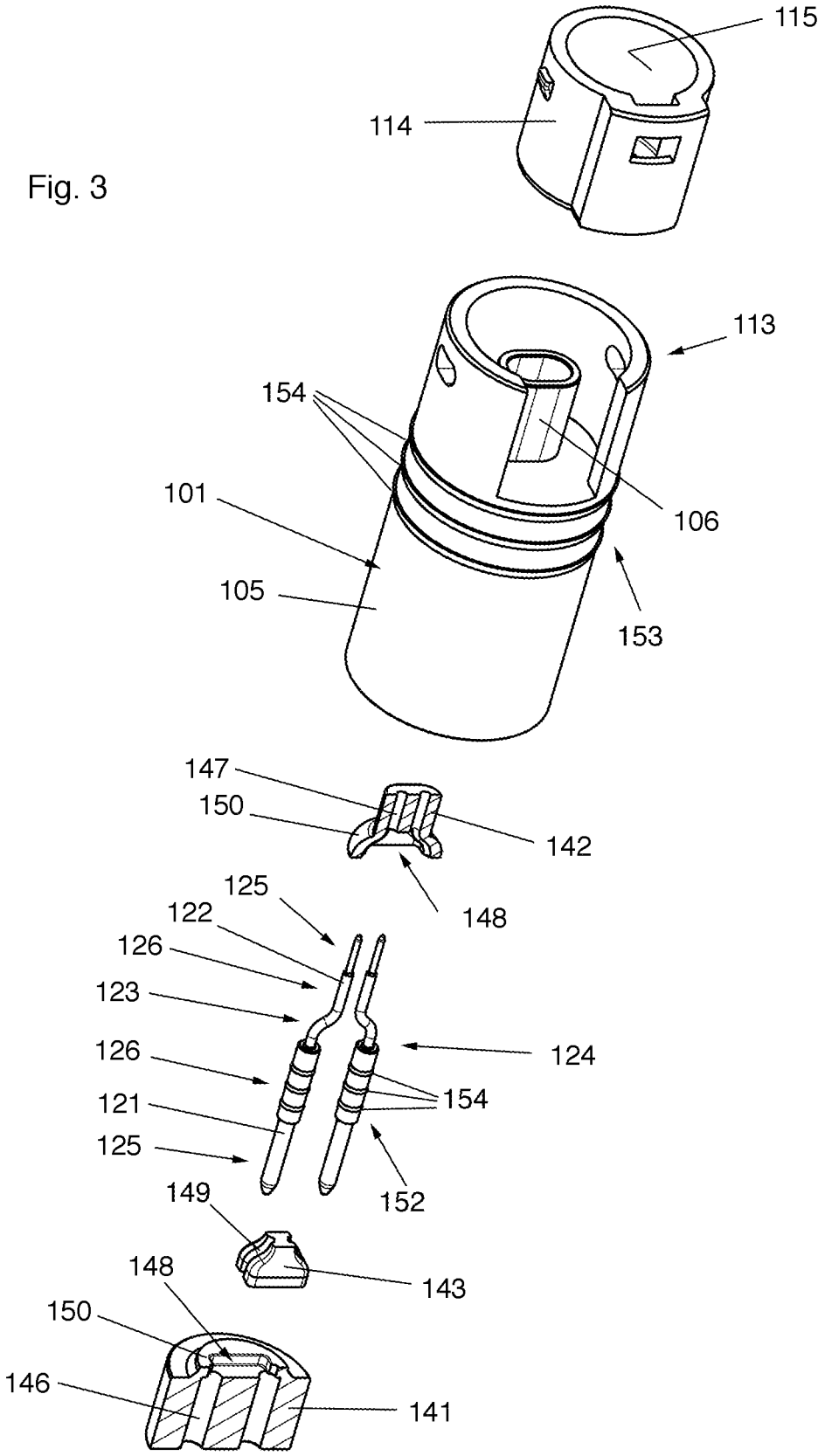
FIG. 3 an exploded partial-section perspective view of the data connector adapter according to FIG. 1.

FIG. 3 shows a partial-section exploded-view drawing of the data connector adapter 100 with the components already described. Reference is made to this description. The design of the contact carrier 120 with the first and second contacts 121, 122 and the first, second and third carrier bodies 141, 142, 143 will be described in further detail below. It is shown that the overall contact 124 in the contact connection section 123 is intentionally bent to achieve a different spacing between the first contacts 121 and the second contacts 122.

The first carrier body 141 has first through-openings 146 for the first contacts 121, and the second carrier body 142 has second through-openings 147 for the second contacts 122. Furthermore, a third carrier body 143 is accommodated in the intermediate space 148 between the first and second carrier bodies 141, 142 and between the contact connection sections 123. The third carrier body 143 has groove-like recesses 149 (as guides) corresponding to the bend of the contact connection sections 123 of the overall contact 124 into which the bent contact connection sections 123 can be or are accommodated in an assembled data connector adapter 100 (see FIG. 1). Furthermore, the first carrier body 141 and/or the second carrier body 142 each have projecting collars 150 in the direction of the contact connection section 123 along their respective outer circumferential surface, which collars bear against the inner wall surface 145 of the plug shield 104 and enclose the contact connection sections 123 together with the third carrier body 143 accommodated between them. In the assembled state, a common collar 150 is formed.

The thickness of the collar 150 of the first carrier body 141 and/or the thickness of the collar 150 of the second carrier body 142 preferably corresponds approximately to the spacing between the overall contact 124 accommodated in the carrier bodies 141, 142, so that the thickness of the dielectric having the corresponding dielectric constant $\varepsilon_{R1}$, $\varepsilon_{R2}$ remains roughly equal between the overall contact 124 transmitting the data signal and the plug shield 104, even in the region of the contact connection section 123.

FIG. 4 shows the second plug connection end described in FIG. 2 again in detail.

Figure 5:
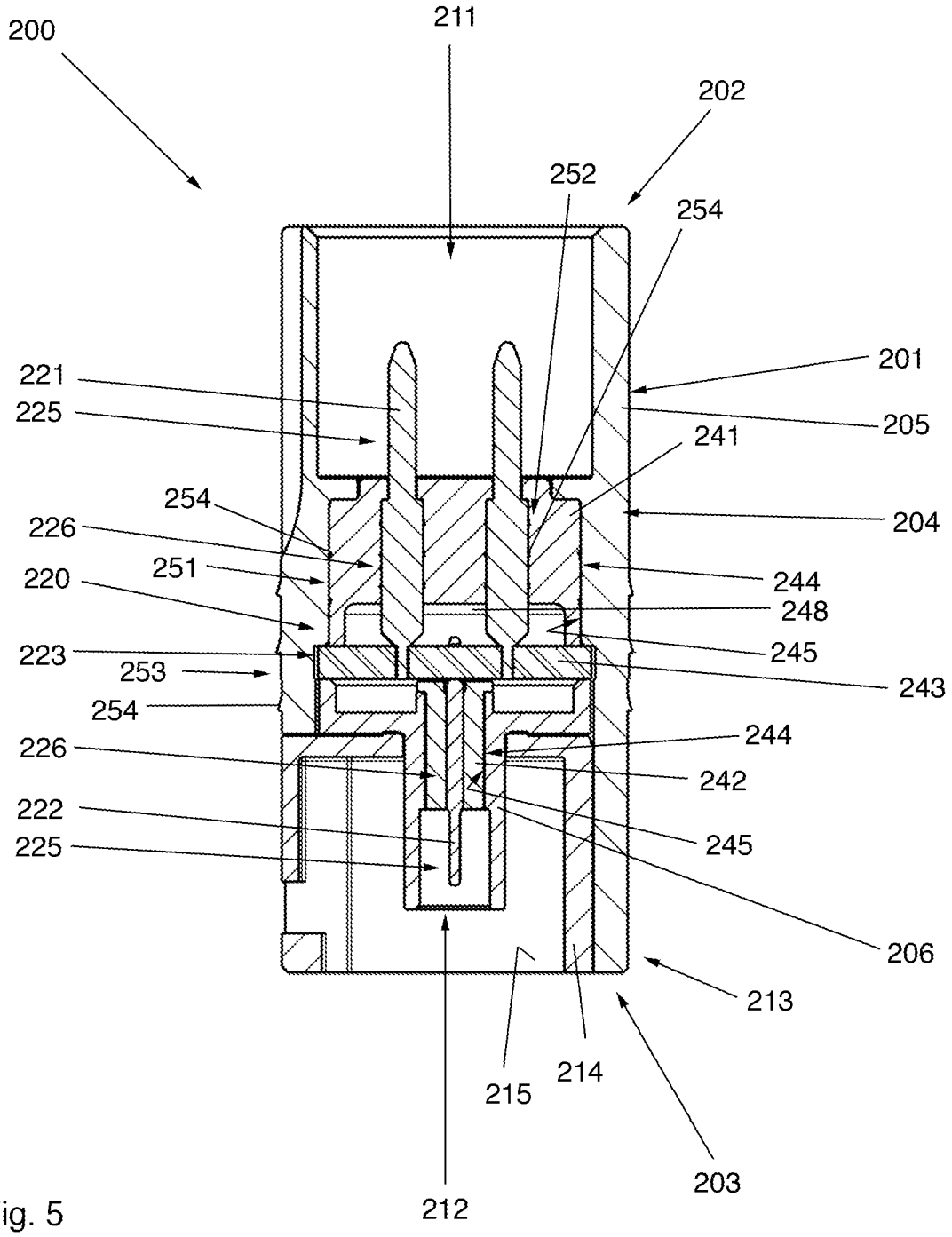
FIG. 5 a cross-sectional view of an inventive data connector adapter according to a further embodiment of the invention.

Similarly to the above-described first embodiment, FIG. 5 shows a data connector adapter 200 for data transmission with a plug body 201 having a first plug connection end 202 and a second plug connection end 203. The first and second plug connection ends 202, 203 are surrounded by an electrically conductive plug shield 204 comprising a socket-type first part of the plug shield 205 and a second part of the plug shield 206.

The first part of the plug shield 205 forms an insertion opening for a data connector at both the first and second plug connection ends 202, 203. The first plug connection end 202 shows a first plug contact connection pattern 211 for the connection of a first data connector 11 and the second plug connection end 203 shows a second plug contact connection pattern 212 for the connection of a second data connector 12.

A contact carrier 220 is accommodated in the plug body 201, wherein the contact carrier 220 is arranged between the first and second plug connection ends 202, 203 and carries at least two first contacts 221 and at least two second contacts 222, which are arranged such that the first contacts 221 form the first plug contact connection pattern 211 and the second contacts 222 form the second plug contact connection pattern 212. In each case, exactly one of the first contacts 221 is electrically conductively connected to exactly one of the second contacts 222 via a contact connection section 223, wherein the contact connection section 223 is part of a circuit board, which also serves as a third carrier body 243 of this embodiment.

In this embodiment, the first plug contact connection pattern 211 and the second plug contact connection pattern 212 are rotated 90° relative to one another, so that of the two first contacts 221 both contacts 221 can be seen, but of the two second contacts 222 only one contact 222 can be seen.

As with the first embodiment, the first part of the plug shield 205 also surrounds the first contacts 221 at the first plug connection end 202. The second contacts 222 are also (additionally) surrounded by the second part of the plug shield 206, which is arranged within the first part of the plug shield 205. However, in this second exemplary embodiment, the first part of the plug shield 205 and the second part of the plug shield 206 are formed in two parts. The first part of the plug shield 205 and the second part of the plug shield 206 together form the plug shield 204 by arranging the two parts in the data connector adapter 200 in an electrically conductive connection to each other. The first part of the plug shield 205 also forms the socket-type plug body 201.

In the second exemplary embodiment, the contacts 221, 222 are formed as multi-part contacts, wherein the first contacts 221 and the second contacts 222 are each formed as male contacts which are held and contacted in the circuit board as a third carrier body 243. The contact connection section 223 of each contact, i.e., the electrically conductive connection between each first contact 221 and each second contact 222, is formed by a conductor track formed on the circuit board 243 (see FIG. 7).

The first contacts 221 are surrounded at least in sections (with their carrier region 226) by an electrically insulating first carrier body 241 having a first dielectric constant $\varepsilon_{R1}$, and the second contacts 222 are surrounded at least in sections (with their carrier region 226) by an electrically insulating second carrier body 242 having a second dielectric constant $\varepsilon_{R2}$, wherein the outer circumferential surfaces 244 of the first and second carrier bodies 241, 242 bear against an inner wall surface 245 of the plug shield 204, against an inner wall surface 245 of the first part of the plug shield 205 and of the second part of the plug shield 206, respectively.

The contacting regions 225 of the first and second contacts 221, 222 project out of their respective carrier bodies 241, 242.

The third carrier body 243 provided in this embodiment takes the form of a circuit board having a third dielectric constant $\varepsilon_{R3}$ arranged between the first and second carrier bodies 241, 242. Both the first carrier body 241 and the second carrier body 242 extend up to the circuit board 243, wherein a free space 248 is formed in the first carrier body 241 in the center between the circuit board 243 and the first carrier body. On the other hand, the second carrier body 242 rests with its entire end face on the circuit board 243.

According to an embodiment of the invention, the diameters of the first and/or second contact 221, 222 in the first and/or second carrier body 241, 242, the diameters of the contact connection section 223 (in the sense of the dimensioning of the conductor track 224), the spacing of the first contacts 221 from the outer circumferential surface 244 of the first carrier body 241, the spacing of the second contacts 222 from the outer circumferential surface 244 of the second carrier body 242, the spacing of the contact connection section 223 from the outer circumferential surface 244 of the first and/or second carrier body 241, 242, the shape of the outer circumferential surface 244 of the first and/or the second carrier body 241, 242 (and thus in other words the shape of the inner wall surface 245 of the plug shield 204 in the regions in which the outer circumferential surface 244 of the first and/or second carrier body 241, 242 bears against the inner wall surface 245), the dielectric constant $\varepsilon_{R1}$ of the first carrier body 241, the dielectric constant $\varepsilon_{R2}$ of the second carrier body 242, the dielectric constant $\varepsilon_{R3}$ of the third carrier body 243 and/or the shape of its outer surface are set in such a way that the impedance in the data connector adapter 200 corresponds to a predetermined impedance value and a data transmission through the data connector adapter 200 at the desired data rate is not disturbed. This has already been described in detail.

Figure 7:
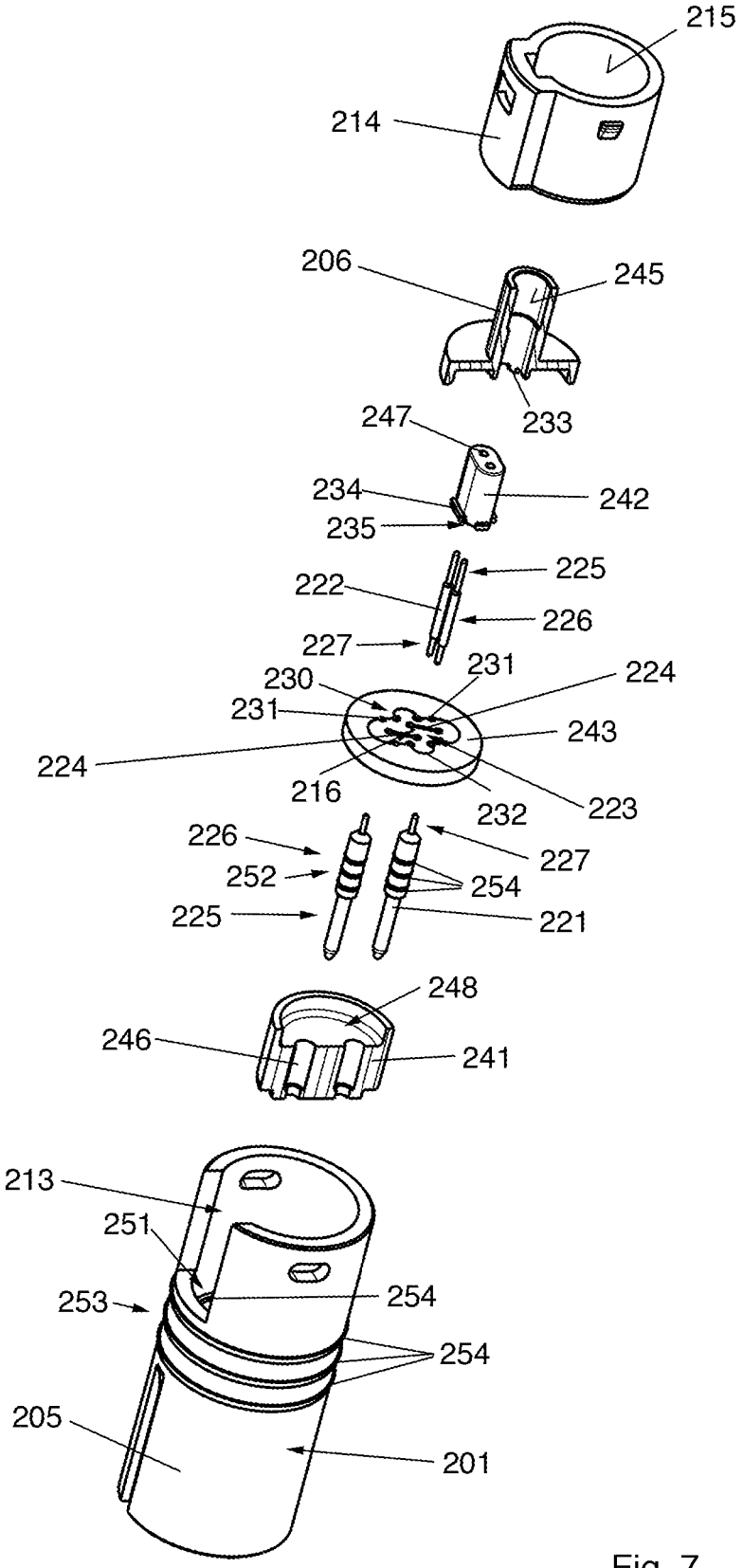
FIG. 7 an exploded partial-section perspective view of the data connector adapter according to FIG. 5.

FIG. 7 shows a partial-section exploded-view drawing of the data connector adapter 200 with the components described above. Reference is made to this description. The design of the contact carrier 220 with the first and second contacts 221, 222 and the first, second and third carrier bodies 241, 242, 243 will be described in further detail below. It is shown that the contact carrier 220 does not have an overall contact like the first embodiment of the data connector adapter 100. Instead, the first contacts 221 and the second contacts 222 take the form of male contacts arranged and contacted at different spacing from each other on the circuit board 243. The circuit board simultaneously also forms the third carrier body 243.

The first carrier body 241 has first through-openings 246 for the first contacts 221 and the second carrier body 242 has second through-openings 247 for the second contacts 222.

The contact connection section 223 includes as the third carrier body 243 the board on which the first contacts 221 and the second contacts 222 are contacted and fixed on different sides of the board by means of their circuit board connector sections 227. The circuit board connector sections 227 are formed in each case as thin male contact regions of the first and second contacts 221, 222.

On the board 243, the conductor tracks 224 are provided for connecting in each case one of the first contacts 221 to one of the second contacts 222.

Furthermore, a contact shield 230, which is electrically conductively connected to the plug shield 204, is provided on the circuit board 243 around the conductor tracks 224 connecting the contacts 221, 222. This contact shield 230 is formed in the third carrier body 243, which is designed as a circuit board, by a plurality of via points 231 which are connected to one another via conductor tracks 232 on one or both circuit board sides. The conductor tracks 232 of the contact shield form a closed region around the first and second contacts 221, 222 as well as the conductor tracks 224 of the contact connection section 223 that connect them.

The arrangement and shape of the conductor tracks 232 of the contact shield and/or the vias 231 connected to these conductor tracks 232 can also be used as the parameters described above. According to the configuration shown in FIG. 7, it is provided that the shape of the conductor tracks 232 is selected to be arcuate, such that the spacing from the first and second contacts 221, 222 is as constant as possible, i.e. follows a shape in which variations in spacing are minimized. Furthermore, the spacing of the first and second contacts 221, 222 from the contact shield 230 corresponds approximately to the spacing of the conductor tracks 224 connecting the contacts 221, 222, which are arranged parallel to one another. For this purpose, the first contacts 221 of the first contact connection pattern 211 and the second contacts 222 of the second contact connection pattern 212 are rotated relative to one another about 90°, wherein the rotation is carried out about a center point or center of gravity 216 of the connection patterns 211, 222 relative to the position of the contacts 221, 222. In the illustrated exemplary embodiment, the center point or center of gravity 216 corresponds to the center of the circle of the round circuit board without the invention being limited to such a configuration.

As already described, the plug shield 204 is constructed in two parts and comprises as separate parts a first part of the plug shield 205, which is formed by the socket-type plug body 201, and a second part of the plug shield 206, which is accommodated in the first part of the plug shield 205, for example by insertion or press-fitting, and surrounds the second contacts 222 of the second plug contact connection pattern 212. The first and second parts 205, 206 of the entire plug shield 204 are electrically conductively connected to each other after assembly.

The electrical connection between the plug shield 204 and the contact shield 230 is effected in the illustrated exemplary embodiment by conductors in the second carrier body 241. For this purpose, contact projections 233, which project in the assembled data connector adapter 220 at via points 231 of the contact shield, are provided on the second part of the plug shield 206 in the direction of the circuit board 243. The contact projections 233 project as conductors through a standing flange 234 formed on the first carrier body 241 on the edge facing the circuit board 243 and in which contact recesses are formed for this purpose.

FIGS. 6 and 8 of the second embodiment correspond to FIGS. 2 and 4 of the first embodiment, wherein, according to the second embodiment, the reference numerals are respectively selected to be higher by the value 100. In terms of content, reference is made to the above description of FIGS. 2 and 4, which also applies in the same manner to the second embodiment of the data connector adapter 200.

In both embodiments, the data connector adapter 100; 200 is protected against moisture penetration by at least two seals 151, 152; 251, 252, wherein a first seal 151; 251 seals off a or the contact surface of plug shield 104; 204 (in the exemplary embodiments specifically of the first part of the plug shield 105; 205) and contact carrier 100; 200 (in the exemplary embodiments, specifically of the first carrier body 141; 241) and a second seal 152; 252 seals a or the contact surface of a contact (in the exemplary embodiments, specifically of the first contact 121; 221) and contact carrier 100; 200 (in the exemplary embodiments, specifically of the first carrier body 141; 241). This reliably prevents the penetration of moisture into the data wiring in the region of the data connector adapter 100; 200 according to an embodiment of the invention.

The seals 151, 152; 251, 252 are formed as mandrel profiles (in the sense of triangular projections) on the inner wall surfaces of the first parts of the plug shield 105; 205 made of metallic material, and the outer circumference of the contacts 121; 221 likewise made of metallic material. The mandrel profiles each press into the contact surfaces of the abutting material, i.e. in this case specifically the first carrier body 141; 241 of the contact carrier 120; 220, under contact pressure, thereby achieving a seal.

In addition, mandrel profiles are formed on the outer circumference of the plug bodies 101; 201 and then act in the same way as a third seal 153; 253 when the data connector adapters 100; 200 are inserted, for example, into a motor vehicle socket 160 for data transmission from a motor vehicle to a motor vehicle component.

The specifically shown seals 151, 152; 251, 252; 153; 253 all take the form of mandrel profiles, each having two or more (triangular) profile projections 154; 254 spaced apart from one another.

FIG. 9 shows in cross-section such a motor vehicle socket 160 according to an embodiment of the invention, having a socket housing 161 which has an insertion opening 162 for connecting a plug of the vehicle component and a connection opening 163 for connecting the socket to a motor vehicle data network or vehicle electrical system, wherein the insertion opening 162 can be sealingly closed off by a hinged cover 164 on the socket housing. For this purpose, a seal 165 is accommodated in the cover 164 and bears sealingly against the edge of the insertion opening 162 when the lid 164 is closed.

In the socket housing 161, an embodiment of the above-described data connector adapter 100 is sealingly fixed, wherein the first plug connection side 102 of the data connector adapter 100 is accessible in the insertion opening 162, and the second plug connection side 103 of the data connector adapter 100 is accessible in the connection opening 163.

The sealing fixation of the data connector adapter 100 in the motor vehicle socket is effected by the seal 153, also designed as a mandrel profile, between the outer circumference of the data connector adapter 100 and a through-opening 166 of the socket housing 161 into which the data connector adapter 100 is received and fixed. The seal 153 formed as a mandrel profile presses into the socket housing 161 made of plastic (corresponding to the type already described) under contact pressure when the data connector adapter 100 is fixed in the through-opening 166. A sealing connection can also be produced, for example, by injection molding or encapsulation.

In the motor vehicle socket 160, further electrical contacts 167, but preferably a plurality of further electrical contacts, are integrated sealingly into the socket housing 161 of the motor vehicle socket 160 in a manner known per se, of which only one contact 167 is shown in the cross-sectional view of FIG. 9. The further electrical contacts 167 can also be contacted in the insertion opening 162 and in the connection opening 163 of the motor vehicle socket 167.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

11 First data connector
12 Second data connector
13 First data cable
14 Second data cable
100 Data connector adapter
101 Plug body
102 First plug connection end
103 Second plug connection end
104 Plug shield
105 First part of the plug shield
106 Second part of plug shield
111 First plug contact connection pattern
112 Second plug contact connection pattern
113 Proprietary connection region
114 Plug adapter sleeve
115 Inner wall of plug adapter sleeve
120 Contact carrier
121 First contacts
122 Second contacts
123 Contact connection section
124 One-piece overall contact
125 Contacting region
126 Carrier region
141 First carrier body
142 Second carrier body
143 Third carrier body
144 Outer circumferential surface of the carrier body
145 Inner wall surface of the plug shield
146 First through-openings
147 Second through-openings
148 Intermediate space
149 Guides formed as groove-like recesses
150 Collar
151 First seal formed as mandrel profile
152 Second seal formed as mandrel profile
153 Third seal formed as mandrel profile
154 Profile projection
160 Motor vehicle socket
161 Socket housing
162 Insertion opening
163 Connection opening
164 Cover
165 Seal of the cover
166 Through-opening
167 Electrical contact
200 Data connector adapter
201 Plug body
202 First plug connection end
203 Second plug connection end
204 Plug shield
205 First part of the plug shield
206 Second part of the plug shield
211 First plug contact connection pattern
212 Second plug contact connection pattern
213 Proprietary connection region
214 Plug adapter sleeve
215 Inner wall of plug adapter sleeve
216 Center point or center of gravity of the first and second plug contact connection patterns
220 Contact carrier
221 First contacts
222 Second contact
223 Contact connection section
224 Conductor track of the contact connection section on the circuit board
225 Contacting region
226 Carrier region
227 Circuit board connection section
230 Contact shield
231 Via points
232 Conductor track of the contact shield on the circuit board
233 Contact projections
234 Standing flange
235 Contact recesses
241 First carrier body
242 Second carrier body
243 Third carrier body configured as a circuit board
244 Outer circumferential surface of the carrier body
245 Inner wall surface of the plug shield
246 First through-openings
247 Second through-openings
248 Free space
251 First seal formed as mandrel profile
252 Second seal formed as mandrel profile
253 Third seal formed as mandrel profile
254 Profile projection
$\varepsilon_{R1}$, $\varepsilon_{R2}$, $\varepsilon_{R3}$ Dielectric constants of the carrier bodies

What is claimed is:

1. A motor vehicle socket for data transmission from a motor vehicle to a motor vehicle component, the motor vehicle socket comprising:

a data connector adapter for data transmission, the data connector adapter comprising:

a plug body having a first plug connection end, a second plug connection end, an electrically conductive plug shield and a contact carrier, the first plug connection end having a first plug contact connection pattern for connecting a first data connector and the second plug connection end having a second plug contact connection pattern for connecting a second data connector, the contact carrier being arranged between the first and the second plug connection ends and carrying at least two first contacts and at least two second contacts, which are arranged such that the first contacts form the first plug contact connection pattern and the second contacts form the second plug contact connection pattern, exactly one of the first contacts in each case being electrically conductively connected to exactly one of the second contacts via a contact connection section;

wherein the first contacts are surrounded at least in sections by an electrically insulating first carrier body having a first dielectric constant $\varepsilon_{R1}$;

wherein the second contacts are surrounded at least in sections by an electrically insulating second carrier body having a second dielectric constant $\varepsilon_{R2}$; and wherein outer circumferential surfaces of the first and second carrier bodies bear against an inner wall surface of the plug shield at least in sections, a socket housing having an insertion opening configured to connect with a plug of the motor vehicle component and a connection opening configured to connect the motor vehicle socket to a motor vehicle data network or vehicle electrical system, wherein the insertion opening can be sealingly closed off by a cover on the socket housing, wherein the data connector adapter is sealingly fixed within the socket housing, and wherein one of the two plug connection ends of the data connector adapter is accessible in the insertion opening, and the other of the two plug connection ends of the data connector adapter is accessible in the connection opening.

2. The motor vehicle socket according to claim 1, wherein a first contact spacing between the first contacts is different from a second contact spacing between the second contacts.

3. The motor vehicle socket according to claim 1, wherein an impedance in the data connector adapter is adjusted to a predetermined impedance value by at least one parameter of a plurality of parameters being varied, the parameters including:

diameter of the first and/or second contact in the first and/or second carrier body;

diameter of the contact connection section;

spacing of the first contacts from the outer circumferential surface of the first carrier body;

spacing of the second contacts from the outer circumferential surface of the second carrier body;

spacing of the contact connection section from the outer circumferential surface of the first and/or second carrier body;

shape of the outer circumferential surface of the first and/or the second carrier body;

dielectric constant $\varepsilon_{R1}$ of the first carrier body; and dielectric constant $\varepsilon_{R2}$ of the second carrier body.

4. The motor vehicle socket according to claim 3, wherein the data connector adapter includes at least a third carrier body having a third dielectric constant $\varepsilon_{R3}$ in a region of the contact connection sections, wherein at least one of the parameters that is varied to arrive at the predetermined impedance value includes at least one of:

dielectric constant $\varepsilon_{R3}$ of the third carrier body; and shape of the outer surface of the third carrier body.

5. The motor vehicle socketdata connector adapter according to claim 1, further comprisingwherein the data connector adapter includes at least a third carrier body having a third dielectric constant gin in a region of the contact connection sections.

6. The motor vehicle socketdata connector adapter according to claim 5, wherein an impedance in the data connector adapter is adjusted to a predetermined impedance value by at least one parameter of a plurality of parameters being varied, the parameters including:

dielectric constant gin of the third carrier body; and shape of the outer surface of the third carrier body.

7. The motor vehicle socket according to claim 5, wherein the third carrier body is disposed in a region between different ones of the contact connection sections that connect one of the first contacts and one of the second contacts.

8. The motor vehicle socket according to claim 5, wherein the third carrier body has an electrically conductive contact shield which is electrically conductively connected to the plug shield.

9. The motor vehicle socket according to claim 1, wherein at least a first one of the contact connection sections, as well as one of the first contacts and one of the second contacts, which are connected by the first one of the contact connection sections, are formed as a one-piece overall contact.

10. The motor vehicle socket according to claim 9, wherein the one-piece overall contact is bent in the first one of the contact connection sections.

11. The motor vehicle socket according to claim 1, wherein the contact connection sections have, as a third or further carrier body, a circuit board on which the first contacts and the second contacts are contacted and fixed on different sides of the circuit board by circuit board connector sections, wherein conductor tracks are disposed on the circuit board for connecting in each case one of the first contacts to one of the second contacts, and wherein a contact shield electrically conductively connected to the plug shield is disposed on the circuit board around the conductor tracks connecting the contacts.

12. The motor vehicle socket according to claim 1, wherein the plug shield has a multi-part structure, wherein a first part of the plug body is a socket in which the first and second contacts with the contact connection sections and the carrier bodies are accommodated, and wherein at least one second part of the plug body is arranged in the first part and surrounds one of the first or second plug contact connection patterns.

13. The motor vehicle socket according to claim 3, wherein the at least one parameter that is varied includes an empirically determined parameter in which, in a measurement by time-domain reflectometry, no impedance changes or interferences are indicated that interfere with data transmission at a desired data rate in a data connector adapter connected to data connectors.

14. The motor vehicle socket according to claim 6, wherein the at least one parameter that is varied includes an empirically determined parameter in which, in a measurement by time-domain reflectometry, no impedance changes or interferences are indicated that interfere with data transmission at a desired data rate in a data connector adapter connected to data connectors.

15. The motor vehicle socket according to claim 1, wherein the data connector adapter includes at least one seal configured to protect the plug body against moisture penetration.

16. The motor vehicle socket according to claim 1, wherein a proprietary connection region is formed on at least one of the first and second connection ends and has a plug adapter sleeve which is insertable in the plug body and respectively surrounds the first or second plug contact connection pattern, and wherein an inner wall of the plug adapter sleeve is designed to receive the respective first or second data connector.

17. A data connector adapter for data transmission, the data connector adapter comprising:

a plug body having a first plug connection end, a second plug connection end, an electrically conductive plug shield and a contact carrier, the first plug connection end having a first plug contact connection pattern for connecting a first data connector and the second plug connection end having a second plug contact connection pattern for connecting a second data connector, the contact carrier being arranged between the first and the second plug connection ends and carrying at least two first contacts and at least two second contacts, which are arranged such that the first contacts form the first plug contact connection pattern and the second contacts form the second plug contact connection pattern, exactly one of the first contacts in each case being electrically conductively connected to exactly one of the second contacts via a contact connection section;

wherein the first contacts are surrounded at least in sections by an electrically insulating first carrier body having a first dielectric constant $\varepsilon_{E1}$;

wherein the second contacts are surrounded at least in sections by an electrically insulating second carrier body having a second dielectric constant $\varepsilon_{E2}$;

wherein outer circumferential surfaces of the first and second carrier bodies bear against an inner wall surface of the plug shield at least in sections; and wherein a third carrier body having a third dielectric constant gin is disposed in a region between different ones of the contact connection sections that connect one of the first contacts and one of the second contacts.

18. A data connector adapter for data transmission, the data connector adapter comprising:

a plug body having a first plug connection end, a second plug connection end, an electrically conductive plug shield and a contact carrier, the first plug connection end having a first plug contact connection pattern for connecting a first data connector and the second plug connection end having a second plug contact connection pattern for connecting a second data connector, the contact carrier being arranged between the first and the second plug connection ends and carrying at least two first contacts and at least two second contacts, which are arranged such that the first contacts form the first plug contact connection pattern and the second contacts form the second plug contact connection pattern, exactly one of the first contacts in each case being electrically conductively connected to exactly one of the second contacts via a contact connection section;

wherein the first contacts are surrounded at least in sections by an electrically insulating first carrier body having a first dielectric constant $\varepsilon_{R1}$;

wherein the second contacts are surrounded at least in sections by an electrically insulating second carrier body having a second dielectric constant $\varepsilon_{R2}$;

wherein outer circumferential surfaces of the first and second carrier bodies bear against an inner wall surface of the plug shield at least in sections; and wherein the contact connection sections have, as a third or further carrier body, a circuit board on which the first contacts and the second contacts are contacted and fixed on different sides of the circuit board by circuit board connector sections, wherein conductor tracks are disposed on the circuit board for connecting in each case one of the first contacts to one of the second contacts, and wherein a contact shield electrically conductively connected to the plug shield is disposed on the circuit board around the conductor tracks connecting the contacts.

* * * * *